US007267053B2

(12) United States Patent
Beitel et al.

(10) Patent No.: US 7,267,053 B2
(45) Date of Patent: Sep. 11, 2007

(54) DELIVERY DEVICE FOR A SHEET-PROCESSING MACHINE

(75) Inventors: Ulrich Beitel, Sulzbach (DE); Eckhard Braun, Rodgau (DE); Rolf Martin Lange, Offenbach (DE)

(73) Assignee: MAN Roland Druckmaschinen AG, Offenbach (DE)

( * ) Notice: Subject to any disclaimer, the term of this patent is extended or adjusted under 35 U.S.C. 154(b) by 6 days.

(21) Appl. No.: 10/514,773

(22) PCT Filed: May 2, 2003

(86) PCT No.: PCT/EP03/04630

§ 371 (c)(1),
(2), (4) Date: Jul. 18, 2005

(87) PCT Pub. No.: WO03/097360

PCT Pub. Date: Nov. 27, 2003

(65) Prior Publication Data

US 2006/0042487 A1 Mar. 2, 2006

(30) Foreign Application Priority Data

May 17, 2002 (DE) ..... 102 22 543

(51) Int. Cl.
*B65H 29/58* (2006.01)

(52) U.S. Cl. ..... 101/232; 101/240; 271/3.18; 271/3.19; 271/198; 271/290

(58) Field of Classification Search ..... 101/232, 101/240, 408; 271/3.18, 3.19, 204, 290, 271/66, 198
See application file for complete search history.

(56) References Cited

U.S. PATENT DOCUMENTS

| | | | | |
|---|---|---|---|---|
| 5,592,878 | A * | 1/1997 | Eltner | 101/231 |
| RE35,495 | E * | 4/1997 | Bolza-Schuenemann et al. | 101/232 |
| 6,192,140 | B1 * | 2/2001 | Reinhard et al. | 382/112 |
| 6,257,139 | B1 * | 7/2001 | Schaede | 101/232 |
| 6,877,427 | B2 * | 4/2005 | Dunninger et al. | 101/408 |

FOREIGN PATENT DOCUMENTS

| | | |
|---|---|---|
| DE | 2430212 A1 | 1/1976 |
| DE | 19819491 C1 | 9/1999 |
| DE | 19819490 C1 | 10/1999 |

(Continued)

*Primary Examiner*—Daniel J. Colilla
*Assistant Examiner*—Kevin D. Williams
(74) *Attorney, Agent, or Firm*—Leydig, Voit & Mayer, Ltd.

(57) ABSTRACT

The invention relates to a delivery device for a sheet-processing machine. The object of the invention is providing a delivery device on a sheet-fed rotary printing machine, that can be universally used and permits quality control of the printed and/or laminated sheets. to this end the delivery device includes rotating sheet feeding system 5 supplying the printed sheets to a first delivery stack 9 and with a drum 7 acting as a turnout point in front of this delivery stack 9 in the transport direction 2 for selective sheet removal. The drum 7 is allocated to the sheet feeding system 5. A vacuum table 14 coupled with a pneumatic system and with at least one rotating suction belt for suctioning, transporting, and positioning a sheet is arranged downstream from the drum in its rotational direction. At least one quality control device 12 for inspecting the sheet is arranged at a distance to the vacuum table 14, with the second delivery system 8 being arranged downstream from the vacuum table 14.

7 Claims, 1 Drawing Sheet

FOREIGN PATENT DOCUMENTS

| | | | | |
|---|---|---|---|---|
| DE | 20021623 | U1 | | 2/2001 |
| EP | 0527453 | A1 | | 2/1993 |
| EP | 0820864 | A1 | | 1/1998 |
| EP | 1034927 | A1 | | 9/2000 |
| GB | 2336836 | A | * | 11/1999 |

* cited by examiner

DELIVERY DEVICE FOR A SHEET-PROCESSING MACHINE

FIELD OF THE INVENTION

The invention relates to a delivery device for a sheet-processing machine and preferably a delivery can be used for sheet-printing machines and/or sheet-laminating machines.

BACKGROUND OF THE INVENTION

A delivery device of this type for sheet-fed rotary printing machines is disclosed in DE 24 30 212 A1. The delivery device has a sorting device, which delivers printed copies selectively to two delivery stacks. The printed copies are subject to measurement-related quality control within the printing machine. A rotating first chain conveyor supplies the printed copies to a first delivery stack. A removal drum with gripper systems is allocated to the first chain conveyor. A second chain conveyor is arranged after the removal drum. Depending on the determined quality, the printed copies can be deposited on the first or second delivery stack.

DE 198 19 491 C1 discloses a sheet delivery unit for a rotary printing machine with an endlessly rotating feeding system supplying the sheets to a first delivery stack and with a drum acting as a turnout point before the delivery stack and featuring at least one gripper system. The drum is used for selective or constant sheet removal and is allocated to the lower track of the feeding system. For the purpose of delivering the sheets, a second stacking system is arranged adjacent to the drum. Outside the lower track, a sheet guidance device is arranged with an opening extending across the format width. The gripper system of the drum intersects the opening with its orbit and the second stacking system is arranged approximately underneath the drum. The second stacking system can be embodied as a pallet or screen box, e.g., for removing spoiled sheets, and also as a stacking system with stopping and jogging elements for forming exact stacks.

Another delivery unit for a sheet-fed rotary printing machine is disclosed in DE 198 19 490 C1. This delivery device has several sheet feeding systems, with a transfer cylinder being arranged between a first and a second sheet feeding system. A first stacking system (main stack) is allocated to the second sheet feeding system and a second stacking system (deep stack) is allocated to the transfer cylinder. A third sheet feeding system running above the second sheet feeding system leads from the transfer cylinder to a storage area for sheets. A measurement device, which preferably is moveable, is allocated to this storage area for scanning the top side of a sheet.

A disadvantage of this arrangement is that the second stacking system can be used only for storing spoiled sheets or for the temporary storage of sheets during nonstop stack alternating in the first stacking system.

BRIEF SUMMARY OF THE INVENTION

A general object of the present invention is creating a delivery device in a sheet-processing machine which prevents the aforementioned disadvantages and which permits universal use as well as quality control of printed and/or laminated sheets.

A first advantage of the present invention is that quality control of individual sheets can be realized in the delivery of printed or laminated sheets while the predominant number of printed and/or laminated sheets can be fed to a first delivery stacking system (main stack). In the transport direction of the sheets, a drum acting as a turnout point with at least one gripper system is arranged before the first delivery stacking system. By means of this drum, individual sheets, which otherwise would be deposited on the first delivery stack, can be sorted from the transport stream during the continuous printing operation. Here, on the basis of the time or the number of sheets, as an alternative to the determined quality of already inspected sheets, one sheet can be periodically sorted from the sheet transport stream by means of the drum and fed to at least one quality measurement device.

Another advantage is that based on the quality measurement, each sorted sheet can be fed to a subsequent, second storage system. The storage system is, e.g., in a simple configuration, a compartment for sheets, alternatively a subsequent deep stacking device (with at least front-edge stops) or a screen box.

A further advantage is that the quality measurement device be coupled to a machine controller (e.g., a control station) by means of circuitry, and that the determined data can be fed to the machine controller, e.g., for logging, and/or electronic color control or for retrievable data storage. Preferred quality measurement devices that can be operated according to the principle of colorimetry or densitometry thus support the production of sheet material of consistently high quality during the continuous printing operation.

It is likewise an advantage that potential errors in the printing process can be prevented by means of the quality control and thus the process stability for delivering the sheets onto the first delivery stacking system is increased

BRIEF DESCRIPTION OF THE INVENTION

Figure 1:
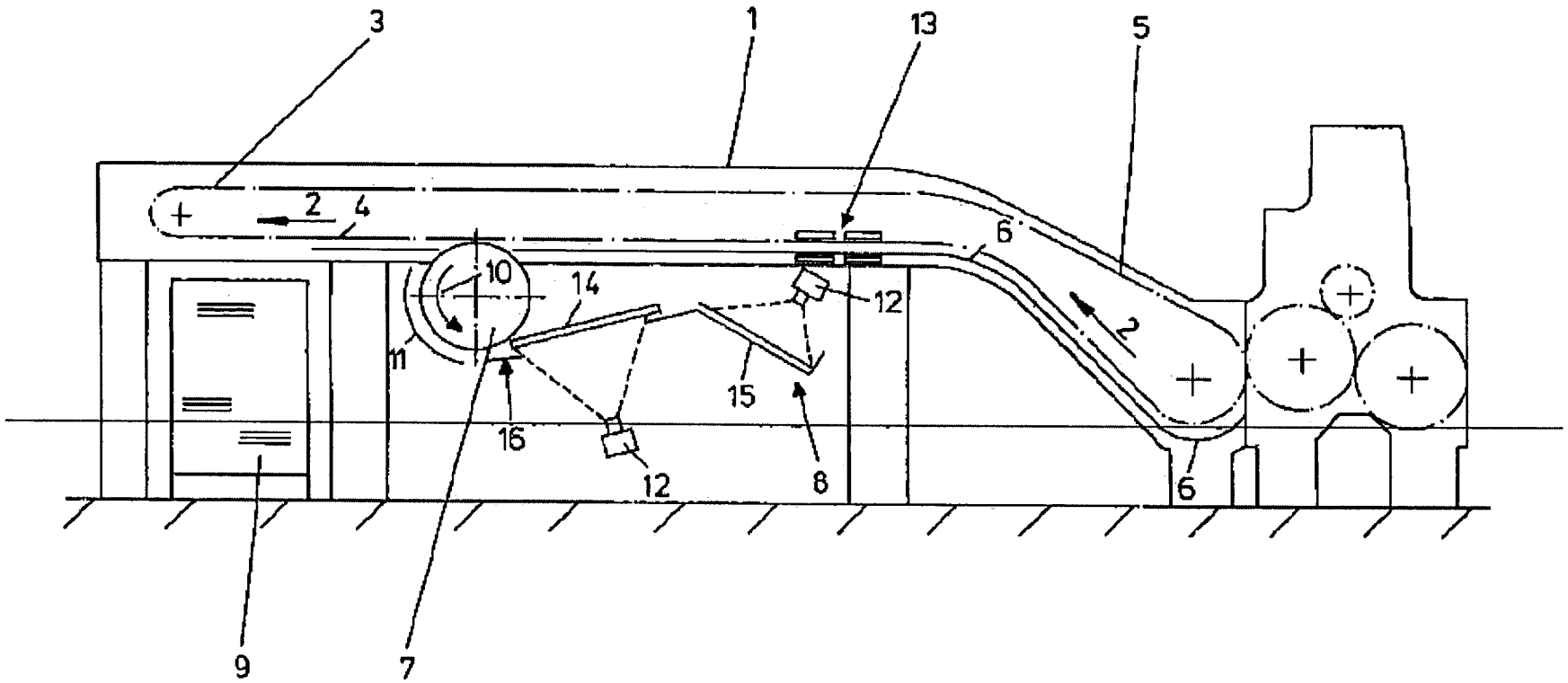
FIG. 1 is a schematic side view of an exemplary delivery device according to the invention having with a first stacking system and two quality measurement devices.

In FIG. 1, a delivery device 1 of a sheet-fed rotary printing machine is arranged downstream of a printing press or laminating press in the transport direction 2 of the sheets to be stored. Among other things, the delivery device 1 includes an endlessly rotating sheet feeding system 5 with several gripper systems fixed to this system. The sheet feeding system 5 is configured with an upper and a lower track 3, 4, preferably as a chain conveyor. The sheet feeding system 5 feeds printed and/or laminated sheets to a first delivery stack 9 (main stacking system) and deposits the sheets there.

A sheet guidance device 6, which can preferably be operated pneumatically, is allocated to the lower track 4 of the sheet feeding system 5 and is arranged at a small distance therefrom. An opening in the sheet guidance device 6 extending across the format width is arranged a small distance from the sheet feeding system 5 outside the lower track 4. A sheet-guiding drum 7 is allocated underneath in the area of the opening to the lower track 4. The drum 7 has at least one gripper system on its periphery, which intersects the opening with its orbit. A second storage system 8 is arranged downstream of the sheet-grinding drum 7 with at least one quality measurement device 12 connected in-between.

The sheet feeding system 5 extends over the first delivery stack 9 functions as a main stack. In the transport direction 2, the sheet-guiding drum 7 is allocated to the sheet feeding system 5 before the first delivery stack 9. Moreover, in the transport direction 2, preferably dryer systems 13 (UV dryer, IR dryer, or other systems) are preferably arranged before the sheet-grinding drum 7.

The drum 7 is preferably formed as a double diameter drum 7, relative to a single offset blanket/forming cylinder, with two gripper systems arranged symmetrically on the periphery. Likewise, the drum 7 can be configured with a single diameter and one gripper system, as well as with several diameters with a corresponding number of gripper systems arranged symmetrically about the periphery.

The drum 7 acts as a turnout point for selective removal of sheets from the transport stream of the rotating sheet feeding system 5. For this purpose, the drum 7 is allocated to the sheet feeding system, preferably in a horizontal part of this sheet feeding system 5 and the sheet fed to the drum 7 can be fed in the rotational direction 10 of the drum 7 to at least one downstream quality measurement device 12.

In the rotational direction, a sheet guide 11, which is preferably coupled to a pneumatic system, is arranged in the sheet outlet at a defined distance from the orbit of the gripper system of the drum 7.

A vacuum table 14, which is coupled to a pneumatic system and which can be operated with at least one, preferably several, rotating suction belts, is arranged downstream of the drum 7 in it rotational direction drum. The vacuum table 14 with suction belts is used for suctioning, transporting, and positioning a single sheet. At a defined distance from the vacuum table 14, at least one quality measurement device 12 can be arranged. The second storage system 8 is arranged downstream from the vacuum table 14. A guide element 16 for "peeling" and guiding the individual sheets up to the take-over by the suction belts of the vacuum table 14 is preferably arranged between the drum 7 and the vacuum table 14.

In the present example, at least one first quality measurement device 12 is allocated to the vacuum table 14 such that preferably a full sheet side (e.g., the obverse) can be subjected to quality control. Each individual sheet can then be supplied to the second storage system 8 via the suction belts. At least one second quality measurement device 12 is allocated to the second storage system 8 at a defined distance therefrom so that preferably a full sheet side (e.g., the reverse) can be subjected to quality control.

The second storage system 8 can be moved laterally relative to the transport direction 2 into or out of the delivery device 1. The storage system 8 is, e.g., a drawer-shaped compartment 15 with at least one stop for the front edge.

Operation of the illustrated delivery device is as follows: A sheet transported by the sheet feeding system 5 is fed in the transport direction 2 to a first delivery stack 9 and deposited there. Here, the gripper systems of the drum 7 are inactive. If an individual sheet is to be subjected to sheet inspection, then the gripper systems of the drum 7 are activated. The sheet is transported in the rotational direction 10 of the drum 7 at the guide element 16 to the suction belts of the vacuum table 14 and there positioned according to format and held by means of a vacuum with its rear side against the table plate of the vacuum table 14. In this rest position, the front side is open so that quality control can be conducted by the first quality measurement device 12. Here, preferably the obverse side of the sheet is inspected. Then, the suction belts of the vacuum table 14 transport the individual sheet further in the direction of the storage system 8. The sheet is preferably laid against a format-variable stop. In this rest position, the rear side is open so that the second measurement device 12 can inspect the reverse side of the sheet. The second storage system 8 then can be moved laterally from the delivery device 1 preferably using drawer technology.

LIST OF REFERENCE SYMBOLS

1 Delivery device
2 Transport direction
3 Upper track
4 Lower track
5 Sheet feeding system
6 Sheet guide device
7 Drum
8 Second storage system
9 First delivery stack
10 Rotational direction
11 Sheet guidance
12 Quality measurement device
13 Dryer system
14 Vacuum table
15 Compartment
16 Guide element

What is claimed is:

1. A delivery unit for a sheet-fed rotary printing machine comprising:

an endless sheet conveying system having upper and lower tracks for feeding sheets from the printing machine to a first delivery stack with said sheets traveling along said lower track;

a sheet removal drum acting as a turnout point upstream of the first delivery stack relative to the sheet conveying direction, said sheet removal drum including at least one gripper system and being adjacent said lower track of the endless sheet conveying system; said sheet removal drum being selectively operable for removing a sheet being transferred by said endless sheet conveying system as it is traveling along said lower track without interrupting the transfer of other sheets to said first sheet delivery stack;

a second sheet storage system arranged downstream of the sheet removal drum;

a sheet guide device arranged in proximity to the lower track of the sheet conveying system for guiding sheets from said sheet removal drum in a direction to the second sheet storage system upon release of the sheet by the gripper system of said sheet removal drum;

a vacuum system arranged downstream of the sheet removal drum in a rotational direction of movement of the sheet removal drum, said vacuum system being coupled to a pneumatic system, said vacuum system including at least one rotating suction belt which operable following release of the sheet by the gripper system of said sheet removal drum for suctioning, transporting and positioning the sheet while said sheet is free of engagement with any grippers, said second sheet storage system being arranged downstream of the vacuum system; and a first quality measurement device for inspecting sheets following release of a sheet by said gripper system and transport of the sheet by said, vacuum system.

2. The delivery unit according to claim 1 further including a second quality measurement device for inspecting sheets, arranged a distance from the second sheet storage system.

3. The delivery unit according to claim 1 wherein the first quality measurement device is coupled to an electronic color control system of the printing machine.

4. The delivery unit according to claim 1 wherein the second sheet storage system is a compartment for sheets.

5. The delivery unit according to claim 1 wherein the second sheet storage system is a deep stack having front-edge stops.

6. The delivery unit according to claim 1 wherein the second sheet storage system is a screen box.

7. The delivery unit according to claim 1 wherein the second sheet storage system is laterally movable relative to the sheet conveying direction.

* * * * *